US006379856B2

(12) United States Patent
Sokol et al.

(10) Patent No.: US 6,379,856 B2
(45) **Date of Patent: *Apr. 30, 2002**

(54) TONER COMPOSITIONS

(75) Inventors: Jeffrey H. Sokol, Pittsford; Edward J. Gutman, Webster, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/773,485

(22) Filed: Feb. 2, 2001

Related U.S. Application Data

(62) Division of application No. 09/132,185, filed on Aug. 11, 1998, now Pat. No. 6,214,507.

(51) Int. Cl.[7] ..... G03G 9/08

(52) U.S. Cl. ..... 430/108.24; 430/108.3; 430/108.6; 430/108.7

(58) Field of Search ..... 430/110, 126, 430/124, 108.7, 108.6, 108.3, 108.22, 108.24

(56) References Cited

U.S. PATENT DOCUMENTS

| | | | | |
|---|---|---|---|---|
| 2,986,521 A | | 5/1961 | Wielicki | |
| 3,590,000 A | | 6/1971 | Palermiti et al. | |
| 3,900,588 A | | 8/1975 | Fisher | |
| 3,944,493 A | | 3/1976 | Jadwin et al. | |
| 4,206,064 A | | 6/1980 | Kiuchi et al. | |
| 4,298,672 A | | 11/1981 | Lu | |
| 4,338,390 A | | 7/1982 | Lu | |
| 4,394,430 A | | 7/1983 | Jadwin et al. | |
| 4,411,974 A | | 10/1983 | Lu et al. | |
| 4,560,635 A | | 12/1985 | Hoffend et al. | |
| 4,883,736 A | | 11/1989 | Hoffend et al. | |
| 4,935,326 A | | 6/1990 | Creatura et al. | |
| 4,937,166 A | | 6/1990 | Creatura et al. | |
| 5,032,872 A | | 7/1991 | Folkins et al. | |
| 5,071,638 A | * | 12/1991 | Yoshie et al. | 424/49 |
| 5,223,368 A | | 6/1993 | Ciccarelli et al. | |
| 5,227,460 A | | 7/1993 | Mahabadi et al. | |
| 5,236,629 A | | 8/1993 | Mahabadi et al. | |
| 5,324,613 A | | 6/1994 | Ciccarelli | |
| 5,352,556 A | | 10/1994 | Mahabadi et al. | |
| 5,422,214 A | * | 6/1995 | Akiyama et al. | 430/111 |
| 5,827,632 A | | 10/1998 | Inaba et al. | |
| 5,948,583 A | | 9/1999 | Silence et al. | |
| 6,214,507 B1 | * | 4/2001 | Sokol et al. | 430/110 |

FOREIGN PATENT DOCUMENTS

| | | | |
|---|---|---|---|
| GB | 1442835 | | 7/1976 |
| JP | 58-216252 A | * | 12/1983 |
| JP | 2-308174 | | 12/1990 |

OTHER PUBLICATIONS

English translation of JP 2–308174 (12/1990).*
Derwent Acc. No. 1984–026411 (1984).*
Alger, Mark S. Polymer Science Dictionary. London: Elsevier Applied Science. (1989)pp. 438 & 440.*
Grant, Roger et al., Grant and Hackh's Chemical Dictionary, Fifth Edition, New York: McGraw–Hill, Inc. p. 532, 1987.
Derwent Acc No. 1991–067825, 1991.

* cited by examiner

*Primary Examiner*—Christopher Rodee
(74) *Attorney, Agent, or Firm*—Oliff & Berridge, PLC; Eugene O. Palazzo

(57) ABSTRACT

A toner composition comprised of binder, colorant, and a surface additive of a coated silica and wherein said silica possesses a BET surface area, in $m^2/g$ of from about 35 to about 65, a bulk density, in grams/liter, of from about 40 to about 60, and and wherein the size diameter determined from the BET measurement is from about 20 to about 100 nanometers.

15 Claims, No Drawings

TONER COMPOSITIONS

This is a division of application Ser. No. 09/132,185 now U.S. Pat. No. 6,214,507 filed Aug. 11, 1998. The entire disclosure of the prior application is hereby incorporated by reference herein in its entirety.

COPENDING APPLICATIONS

Illustrated in U.S. Pat. No. 6,004,714 and the application U.S. Ser. No. 09/132,623 now U.S. Pat. No. 6,190,815, the disclosures of each being totally incorporated by reference, are toners with coated silicas.

The appropriate components and processes of the above copending applications may be selected for the present invention in embodiments thereof.

BACKGROUND OF THE INVENTION

The present invention is generally directed to toner and developer compositions, and more specifically, the present invention is directed to positively, or negatively charged toner compositions, or toner particles containing certain additives of silicas especially coated fumed silica surface additives, and wherein the additives selected are for example, of a large size diameter of from about 20 nanometers to about 100 nanometers, preferably from about 30 to about 50 nanometers and more preferably in embodiments about 40 nanometers in diameter. With the toners of the present invention, in embodiments thereof a number of advantages are achievable, such as excellent triboelectric charging characteristics, substantial insensitivity to relative humidity, especially humidities of from about 20 to about 80 percent, superior toner flow through, high stable triboelectric charging values, such as from about 15 to about 35 and more specifically from about 16 to about 24 microcolumbs per gram as determined for example, by the known tribo blow-off technique using a Faraday cage and wherein the toners enable the generation of developed images with superior resolution, and excellent color intensity. Important advantages associated with the toners of the present invention is the enablement of high transfer image efficiencies of, for example, greater than about 90 percent, and more specifically from about 90 percent to about 97 percent, and yet more specifically from about 90 to about 95 percent, and excellent image developability wherein images with high resolution, substantially no defects, such as scratches, non-uniform image density, and excellent optical densities determined by a Macbeth 1200 series optical densitometer, such as from about 1.2 to about 1.4 or greater are obtainable.

The aforementioned toner compositions can contain colorants, such as pigment particles comprised of, for example, carbon black, magnetite's, or mixtures thereof, cyan, magenta, yellow, blue, green, red, brown, or white components, or mixtures thereof, thereby providing for the development and generation of black and/or colored images, and in embodiments single component development wherein a carrier or carrier particles are avoided. Thus, the toner and developer compositions of the present invention can be selected for electrophotographic, especially xerographic, imaging and printing processes, including color and digital processes.

PRIOR ART

Toner compositions with certain surface additives, including certain silicas and titanias, are known. Examples of these additives include colloidal silicas, with a coating of dichlorodimethylsilane, such as certain coated AEROSILS like R972® available from Degussa Chemicals, which silicas are of a small size, that is from about 8 to about 16 nanometers, metal salts and metal salts of fatty acids inclusive of zinc stearate, aluminum oxides, cerium oxides, titanium oxides and mixtures thereof, which additives are each generally present in an amount of from about 1 percent by weight to about 7 percent by weight, and preferably in an amount of from about 1 percent by weight to about 6 percent by weight. A number of the aforementioned additives are illustrated in U.S. Pat. Nos. 3,590,000 and 3,900,588, the disclosures of which are totally incorporated herein by reference.

Also known are toners containing additives of certain characteristics, such as a small size, coated with a mixture of hexamethyldisilazane (HMDZ), and aminosiloxanes. Problems with these toners include their high cost, small size, and a low triboelectric charge of for example, from about 10 to about 15 microcoulombs per gram ($\mu$C/g) and relative humidity sensitivity. These and other disadvantages are avoided or minimized with the toners of the present invention. More specifically, advantages achievable with the toners of the present invention as compared is to this prior art include minimal impact on the toner fusing properties, excellent admix charging characteristics, for example from about 15 to about 30 seconds, stable development performance, lower cost, and superior image transfer efficiency of the developed toner image.

Developer compositions with charge enhancing additives, which impart a positive charge to the toner particle, are also known. Thus, for example, there is described in U.S. Pat. No. 3,893,935 the use of quaternary ammonium salts as charge control agents for electrostatic toner compositions. U.S. Pat. No. 4,221,856 discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example sulfate, sulfonate, nitrate, borate, chlorate, and the halogens, such as iodide, chloride and bromide, and a similar teaching is presented in U.S. Pat. No. 4,312,933, which is a division of U.S. Pat. No. 4,291,111; and similar teachings are presented in U.S. Pat. No. 4,291,112 wherein A is an anion including, for example, sulfate, sulfonate, nitrate, borate, chlorate, and the halogens. There are also described in U.S. Pat. No. 2,986,521 reversal developer compositions comprised of toner resin particles coated with certain finely divided colloidal silica. According to the disclosure of this patent, the development of electrostatic latent images on negatively charged surfaces is accomplished by using a developer composition having a positively charged triboelectric relationship with respect to the colloidal silica.

Also, there is disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Further, there is disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other patents disclosing positively charged toner compositions with charge control additives include U.S. Pat. Nos. 3,944,493; 4,007,293; 4,079,014; 4,394,430 and 4,560,635 which illustrates a, toner with a distearyl dimethyl ammonium methyl sulfate charge additive.

Moreover, toner compositions with negative charge enhancing additives are known, reference for example U.S. Pat. Nos. 4,411,974 and 4,206,064, the disclosures of which are totally incorporated herein by reference. The U.S. Pat. No. 4,411,974 patent discloses negatively charged toner compositions comprised of resin particles, pigment particles, and as a charge enhancing additive ortho-halo phenyl carboxylic acids. Similarly, there are disclosed in the U.S. Pat. No. 4,206,064 patent toner compositions with chromium, cobalt, and nickel complexes of salicylic acid as negative charge enhancing additives.

There is illustrated in U.S. Pat. No. 4,404,271 a toner composition for developing electrostatic images in which the toner contains a metal complex represented by the formula indicated therein and wherein the metal, ME, can be chromium, cobalt or iron. Also, in U.S. Pat. No. 4,433,040, the disclosure of which is totally incorporated herein by reference, there are illustrated toner compositions with chromium and cobalt complexes of azo dyes as negative charge enhancing additives. Toners with aluminum complex charge additives are illustrated in U.S. Pat. Nos. 5,324,613 and 5,223,368, the disclosures of each of these patent being totally incorporated herein by reference.

The above components, such as the charge additives may be selected for the present invention in embodiments thereof.

SUMMARY OF THE INVENTION

Examples of features of the present invention in embodiments thereof include:

It is a feature of the present invention to provide toner and developer compositions with certain surface additives, and wherein the toners possess a number of advantages of for example, low cohesivity, for example less than about 35 units, or percent, and electrostatic charging values of for example, from about 15 to about 45, and more specifically from about 16 to 24 microcoulombs per gram and an admix time of less than about 15 seconds, and more specifically from about 15 to about 30 seconds as determined in a charge spectrograph.

In another feature of the present invention there are provided negatively charged toner compositions useful for the development of electrostatic latent images including color images.

In yet a further feature of the present invention there are provided reduced relative humidity sensitivity in the range of about 20 to 80 percent relative humidity at temperatures of from 60 to 80° F. as determined in a relative humidity testing chamber, negatively charged toner compositions with desirable admix properties of about 5 seconds to 60 seconds as determined by the charge spectrograph, and preferably less than about 15 seconds and acceptable high stable triboelectric charging characteristics of from about 15 to about 30 microcoulombs per gram.

Another feature of the present invention resides in the formation of toners which will enable the development of images in electrophotographic imaging apparatuses, which images have substantially no background deposits thereon, are substantially smudge proof or smudge resistant, and therefore are of excellent resolution; and further, such toner compositions can be selected for medium or high speed electrophotographic apparatuses, that is, those in the speed range of about 35 to about 100, or more specifically from about 40 to about 65 copies, or prints per minute.

Aspects of the present invention are, for example, a toner composition comprised of binder, colorant, and a surface additive of a coated silica and wherein said silica possesses a BET surface area, in $m^2/g$ of from about 35 to about 65, a bulk density, in grams/liter, of from about 40 to about 60, and and wherein the size diameter determined from the BET measurement is from about 20 to about 100 nanometers; a wherein the coating is comprised of a mixture of aminopolysiloxane and hexamethyldisilazane; a negatively charged toner comprised of resin, colorant, optional wax and a surface additive mixture of a coated fumed silica, and metal oxide and wherein said silica possesses a BET surface area, in $m^2/g$ of about from about 35 to about 65, a bulk density, in grams/liter, of from about 40 to about 60, and and wherein the size diameter determined by the BET measurement is from about 20 to about 100 nanometers; a toner wherein the titanium dioxide is coated with a decylsilane, and the silica core is comprised substantially of silicon dioxide, and with a coating thereover comprised of a mixture of aminopolysiloxane and hexamethyldisilazane; a toner wherein the resin is a styrene acrylate, a styrene methacrylate, a polyester, or a styrene butylacrylate; a toner wherein the coated silica is present in an amount of from about 0.05 to about 7 weight percent; a toner wherein the coating on the silica is comprised of aminopolysiloxane present in an amount of from about 1 to about 5 parts per hundred based on the silica core and the hexamethyldisilazane is present in an amount of from about 65 to about 85 parts per hundred based on the silica core amount; a toner wherein said coated silica possesses a BET surface area, in $m^2/g$ of from about 40 to about 50, a bulk density, in grams/liter, of from about 45 to about 55, and and wherein the size diameter of said coated silica determined from said BET measurement is from about 25 to about 75 nanometers; a toner wherein the coating on the silica is comprised of aminopolysiloxane in an amount of from about 2 to about 4 parts per hundred and the hexamethyldisilazane in an amount of from about 70 to about 80 parts per hundred; a toner wherein the silica additive is of a size diameter of from about 25 to about 75 nanometers; and, the aggregate silica additive size diameter is about 225 to about 400 nanometers; a toner wherein the silica additive is of a size diameter of from about 30 to about 50 nanometers; and the aggregate additive size diameter is about 300 to about 375 nanometers; a toner with a cohesivity of about 4 to about 40 percent, with a stable triboelectrical charge of from about 10 to about 35 microcoulombs per gram, and with an admix time of from less than about 30 seconds, or an admix time of from about 1 to about 29 seconds; a toner further containing toner additives; a toner wherein the additives are charge additives, waxes, metal salts, metal salts of fatty acids, metal oxides, or mixtures thereof; a toner composition further containing a wax component with a molecular weight, $M_w$ of from about 1,000 to about 20,000; a toner composition wherein the wax component is selected from the group consisting of polyethylene and polypropylene; a toner wherein the colorant is a pigment, or a dye; a toner further including a wax and a coated titanium dioxide, and wherein the size diameter of said silica and said titanium dioxide are form about 35 to about 50 nanometers; a toner wherein said silica and said titanium dioxide are each present in an amount of about 0.05 to about 7 weight percent; a toner wherein said silica and said metal oxide are each present in an amount of about 2 to about 4 weight percent; a toner wherein the coating on the silica is comprised of aminopolysiloxane in an amount of about 3 parts per hundred based on the silica core and the hexamethyldisilazane is present in an amount of about 75 parts per hundred based on the silica core amount; a process wherein a photoconductor is charged, exposed with light to form an electrostatic image, followed by developing the electrostatic image with the toner illustrated herein, transferring the developed image to a substrate, fixing the image onto the substrate, and optionally cleaning or removing any residual toner from the photoconductor; an apparatus comprising a photoconductor, a means to charge the photoconductor, a means to expose or form an electrostatic image onto the photoconductor, a means to develop the toner onto the electrostatic image formed on the photoconductor, a means to transfer the developed toner, a means to fix the toner and an optional means to clean or remove any residual toner from the photoreceptor; a two component developer apparatus containing the invention toner, and which apparatus includes one or more magnetic brush rolls, a sump to contain the developer material, a means to add toner to the developer material in the sump, a means to mix the developer in the sump, a means to load the developer material onto the magnetic brush roll or rolls, and a means to supply biases to the magnetic brush roll; a one component developer apparatus containing the invention toner, and which apparatus comprises a donor roll, toner sump, a means to add toner to the sump, a means to mix the toner in the sump, a means to load toner onto the donor roll, a means to charge the toner on the donor roll, and a means to supply the biases to the donor roll; a hybrid scavengeless developer apparatus containing the invention toner, and which hybrid scavengeless developer apparatus comprises a donor roll, a means to supply the biases to the magnetic brush roll, the donor roll, and any electrodes present, and wherein by suitable spacing of the donor roll to photoconductor the toner moves from the donor roll to the image on the photoconductor, and wherein the movement of toner to the photoconductor is assisted by electrodes between the donor roll and photoconductor or electrodes in the donor roll; a toner wherein the core of the silica is comprised of silicon dioxide; a toner wherein the aminopolysiloxane is γ-amino trimethoxy or trimethylsilane, a process which comprised the development of an image with the toner of wherein the image transfer is from about 90 to about 98 percent; and toner compositions comprised of a binder resin, colorant, and external surface additives; toner compositions comprised of binder resin, colorant, optional additives such as charge control additives, wax, especially a low molecular weight wax, such as a wax with a molecular weight, $M_w$, of from about 1,000 to about 20,000, or from about 1,000 to about 10,000, like polypropylene wax 660P available from Sanyo Kasei Kogyo, or a mixture of waxes, especially two waxes, and which toners are blended or mixed with external additives comprised of the coated silicas indicated herein, metal oxides, such as titanium oxides, or titania, especially coated titanium dioxides wherein the coating is for example, decyltrimethoxysilane, and fatty acid salts, such as zinc stearate powders.

The coated silica particles selected for the toners of the present invention are available from Nippon Aerosil C. Ltd. of Japan and DeGussa Chemicals. Information obtained from these sources indicate that the selected silicas are fumed silicas, silicon dioxides, and the like preferably coated with hexamethyldisilazane and aminopolysiloxane, (such as an aminoalkylsiloxane, such as aminotrimethylsilane) and wherein the coated silicas possess a BET (Brunauer, Emmett, and Teller) value, and which BET value is a standard known technical method, see for example, *Powder Surface Area and Porosity,* $2^{nd}$ Edition, S. Lowell, and Jean Shields, Chapman & Hill, 1991, that measures surface area in $m^2/g$, (meters squared per gram) and which surface area is, for example, from about 35 to about 65, and preferably about 50; and with model assumptions there can be calculated, for example, the primary particle size, and wherein the size diameter determined from the BET measurement is large, for example from about 25 to about 50, and preferably, for example, from about 35 to about 40 nanometers; a bulk density, in grams/liter, of from about 40 to about 60, and preferably about 50, and an HCl (total Cl) of less than about 0.015, or from about 0.010 to about 0.015 percent. Machine test results with the Xerox Corporation Document Centre 265, Document Centre 255, and Document Centre 40, indicate that the invention toners and developers preferably enable, for example, excellent print quality and long developer life in excess of about 500,000 prints, or developed images; a surface coverage area for the coated silica of from about 60 to about 100 percent; a toner tribo value of from about 16 to about 24 microcoulombs per gram; a tribo ratio (tribo at 20 percent RH divided by the tribo at 80 percent RH (relative humidity) of about 1.7 or less; unimodal admix characteristics, and an admix time of about 15 to about 30 seconds as determined in a charge spectrograph; a cohesivity at time zero of about 24 to about 36; and, a cohesivity of less than about 35 units or percent after 20 minutes of mixing in the hybrid scavengeless developer system. (The cohesivity is expressed in percent and is a measure of the tendency of the toner particles to stick together.)

The toner compositions of the present invention can be prepared by mixing and heating together resin particles such as styrene polymers, polyesters, and similar thermoplastic resins, colorant wax, especially low molecular weight waxes, and charge enhancing additives, or mixtures of charge additives in a toner extrusion device, such as the ZSK53 available from Werner Pfleiderer, and removing the formed toner composition from the extruder. Subsequent to cooling, the toner composition is subjected to grinding utilizing, for example, a Sturtevant micronizer or AFG grinder for the purpose of achieving toner particles with a volume median diameter of less than about 25 microns, and preferably of from about 7 to about 12 microns, which diameters are determined by a Coulter Counter. Subsequently, the toner compositions can be classified utilizing, for example, a Donaldson Model B classifier for the purpose of removing fines, that is toner particles less than about 4 microns volume median diameter. Thereafter, the resulting toners are blended or mixed with the external additive silicas indicated herein to obtain the final toner product.

Illustrative examples of suitable toner binders, include toner resins, especially thermoplastic resins, like polyamides, polyolefins, styrene acrylates, styrene butadienes, cross-linked styrene polymers, epoxies, polyurethanes, vinyl resins, including homopolymers or copolymers of two or more vinyl monomers; and polyesters, for example, polymeric esterification products of a dicarboxylic acid and a diol comprising a diphenol. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof; and the like, styrene butadiene copolymers with a styrene content of from about 70 to about 95 weight percent, reference the U.S. patents mentioned herein, the disclosures of which have been totally incorporated herein by reference. In addition, crosslinked resins, including polymers, copolymers, homopolymers of the aforementioned styrene polymers, may be selected.

As one toner composition the esterification products of a dicarboxylic acid and a diol comprising a diphenol are selected as the toner binder resin. These resins are illustrated in U.S. Pat. No. 3,590,000, the disclosure of which is totally incorporated herein by reference. Other polyester binder resins include resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol, reactive extruded resin, especially reactive extruded polyesters with crosslinking as illustrated in U.S. Pat. No. 5,227,460, and U.S. Pat. No. 5,352,556, see for example column 10, the disclosures of each of these patents being totally incorporated herein by reference. The resin is present in a sufficient, but effective amount, for example from about 50 to about 99 weight percent.

Colorants, include pigments such as carbon blacks, cyan, magenta, yellow, green, mixtures thereof, and the like, reference the toner patents recited herein and which colorants are present in the toner in various suitable amounts, such as form about 1 to about 20 and preferably from about 2 to about 12 weight percent, and wherein the total of all toner components is about 100 percent, or 100 parts. A preferred colorant is carbon black.

Colorants includes pigment, dyes, mixtures thereof, mixtures of dyes, mixtures of pigments and the like.

Examples of colorants present in suitable amounts such as from about 1 to about 20 and preferably from about 2 to about 10 weight percent, are carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of colorants include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans that may be selected include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL, and known suitable dyes, such as red, blue, green, and the like.

Magnetites that may be selected include a mixture of iron oxides ($FeO.Fe_2O_3$), including those commercially available as MAPICO BLACK™, and are present in the toner composition in various effective amounts, such as an amount of from about 10 percent by weight to about 75 percent by weight.

There can be included in the toner compositions of the present invention charge control additives as indicated herein in various effective amounts, such as from about 1 to about 19, and preferably from about 1 to about 3 weight percent. These charge control additives can be either positively or negatively charge importing to render the toner charge more positive or more negative, respectively. Also, of importance with respect to the present invention is a toner with a mixture of the surface additives of the coated silicas indicated herein and metal oxides, especially titanium dioxide, especially coated titanium dioxides, each with a preferable size of from about 30 to about 70 and more preferably about 40 nanometers to provide for improved image transfer efficiency of, for example, a developed image transfer of at least about 90 percent, and excellent developability, that is, high quality low background images with no scratches or other similar blemishes, and high optical densities of from about 1.2 to about 1.4 or greater. The coating on the titanium dioxide is preferably for example a silane, and more specifically a decyltrimethylsilane, or polymer thereof.

The toner composition according to the present invention may exhibit a charge per particle diameter ratio (i.e., a "q/d" ratio) of from about 0.2 to about 1.1 femtocoulombs per micron.

Moreover, waxes, or mixtures thereof, with a molecular weight $M_w$ (weight average molecular weight) of for example from about 1,000 to about 20,000, such as polyethylene, polypropylene, and paraffin waxes, can be included in, or on the toner compositions as fuser roll release agents. For example, suitable waxes that may be selected are polypropylenes and polyethylenes commercially available from Allied Chemical and Petrolite Corporation, Epolene N-15 commercially available from Eastman Chemical Products, Inc., Viscol 550-P, a low weight average molecular weight polypropylene available from Sanyo Kasei K.K., and the like. The commercially available polyethylenes selected have a molecular weight of from about 1,000 to about 3,000, while the commercially available polypropylenes are believed to have a molecular weight of from about 4,000 to about 10,000. Many of the polyethylene and polypropylene compositions useful in the present invention are illustrated in British Patent No. 1,442,835, the disclosure of which is totally incorporated herein by reference. The wax is present in the toner composition of the present invention in various amounts, however, generally these waxes are present in the toner composition in an amount of from about 1 percent by weight to about 15 percent by weight, and preferably in an amount of from about 2 percent by weight to about 5 percent by weight. In other embodiments, the toners of the present invention may also contain polymeric alcohols, such as UNILINS®, reference U.S. Pat. No. 4,883,736, the disclosure of which is totally incorporated herein by reference, and which UNILINS® are available from Petrolite Corporation, metal salts of fatty acids, such as zinc stearate, and other toner additives such as metal oxides like titanium oxides, and coated titanium dioxides.

Developers include the toners illustrated herein with the mixture of silicas on the surface and carrier particles. Developer compositions can be prepared by mixing the toners with known carrier particles, including coated carriers, such as steel iron, ferrites inclusive of strontium ferrites, and the like, reference U.S. Pat. Nos. 4,937,166 and 4,935,326, the disclosures of which are totally incorporated herein by reference, for example from about 2 percent toner concentration to about 8 percent toner concentration. The carriers can include coatings thereon, such as those illustrated in the U.S. Pat. Nos. 4,937,166 and 4,935,326 patents, and other known coatings. There can be selected a single coating polymer, or a mixture of polymers. Additionally, the polymer coating, or coatings may contain conductive components therein, such as carbon black in an amount, for example, of from about 10 to about 70 weight percent, and preferably from about 20 to about 50 weight percent. Also there can be selected as carrier coating a mixture of polymers, such as polymethylmethacrylate and conductive components, such as carbon black, reference, for example, U.S. Pat. No. 5,236,629, the disclosure of which is totally incorporated herein by reference.

Imaging methods are also envisioned with the toners of the present invention, reference for example a number of the patents mentioned herein, and U.S. Pat. No. 4,265,660, hybrid scavengeless and jumping development, reference U.S. Pat. No. 5,032,872 (HSD) or a modified HSD with wires in the donor roll and wherein there is an absence of wires between the donor roll and the photoreceptor and wherein there are electrodes in the donor roll (SED), the disclosures of each of these patents being totally incorporated herein by reference.

Toners encompassed by the present invention have been tested in a number of Xerox Corporation machines, and more specifically the Document Centre 265, which has a hybrid jumping development system. The hybrid jumping development system is comprised of a two-component magnetic brush developer which loads toner onto a donor roll by the proper choice of bias voltages on the magnetic brush and donor rolls, and the donor roll transports the toner to the development zone which is formed by the photoreceptor and donor roll. The toner is caused to jump from the donor roll to the photoreceptor by the proper selection of image potentials on the photoreceptor and a.c. and d.c. bias potentials on the donor roll. The toners should possess low cohesion properties; if the cohesion of the toner in the developer changes with usage, then the developability will also change. The change in the toner cohesion has been found to occur with long runs (1,000 copies) of originals with different area coverages. The change in toner cohesion can be simulated by mixing the toner in a Hybridizer (NARA HYBRIDIZER™ Nara Machinery Co. Ltd., Tokyo, Japan).

The cohesion properties of toners of the present invention in embodiments thereof as measured by the Hosokawa Powder Tester modified to use screen sizes of 53 micrometers (sieve screen number 270), 45 micrometers (sieve screen number 325), and 38 micrometers (sieve screen number 400) are in embodiments low, for example, less than about 35 and more specifically from about 20 to about 40. The following table summarizes the improvement in cohesivity stability measured with a bench test after 18 seconds of vigorous agitation for the invention NA50HS formulation, which has a change in cohesivity of 10 units compared to the prior art coated silica RX515H formulation which has a change in cohesivity of 20 units; and the prior art small (conventional size of about 8 nanometers) additive formulation with 0.6 weight percent of TS530 silica which has a change in cohesivity of 69 units. The bench test with the hybridizer simulates the aging of toner in a hybrid scavengeless developer housing and wherein the time in seconds (secs.) such as 18 seconds recited simulates the energy input of the developer housing for 20 minutes of mixing time. An ideal response for a toner is a cohesivity less than about 32 units and no change in the cohesivity of the toner with agitation time. The cohesivity changes primarily since the state of the additives on the toner surface changes, for example, by being pushed into the toner surface and in view of the coated silicas selected. With long enough agitation times, for example from about 3 to about 10 minutes, the toners can become cohesive. The NA5OHS toner required longer agitation times to become cohesive. A cohesivity of about 32 can be of importance for high copy quality since as the cohesivity increases the image quality degrades by becoming less optically dense.

| Time (secs.) | 0.6 percent TS530 Silica 1.8 percent Titania and 0.2 percent Zinc Stearate | 3.6 percent RX515H Silica 2.5 percent Titania and 0.2 percent Zinc Stearate | 3.6 percent NA50HS Silica 2.5 percent Titania and 0.2 percent Zinc Stearate |
|---|---|---|---|
| 0 | 13.2 | 22.1 | 22.5 |
| 18 | 82.2 | 42.2 | 32 |

The TS530 (fumed silica core coated with HMDZ) and RX515H (fumed silica core coated with γ-aminotrimethoxysilane and hexamethyldisilazane) silicas are prior art silicas, and the NA50HS silica is a coated fumed silica of the present invention. A cohesivity value of 82.2 units, or percent, above represents a sticky toner that will not transfer well, for example about 50 percent or less; the 42.2 cohesivity results in an image transfer of about 85 percent, and the invention coated silica with a cohesivity of 32 above results in excellent transfer of the developed image of at least 90 percent, and more specifically, from about 90 to about 95 percent. The charge distribution obtained with the NA50HS toner is narrow and is unimodal 15 seconds, compared to about 90 seconds to about 120 seconds for toners with the prior art coated silicas recited in the table above, after toner is admixed into the developer, and the rapid charging of added toner results in low background on the prints.

The RH sensitivity of toners and developers can be determined as follows. The toner and carrier were conditioned overnight in a chamber set to the desired environmental conditions, for example, 60° F. and 20 percent relative humidity (C zone) and 80° F. and 80 percent RH (A zone). The conditioned toner and carrier were blended together and then mixed on a roll mill to generate the triboelectric charge. The triboelectric charge was determined by the conventional tribo blow-off technique. The RH sensitivity was the ratio of the tribo value at 60 deg./20 percent RH to the tribo value at 80 deg./80 percent RH. For the toners of the present invention using the NA50HS silica, there was measured a C zone tribo value of 23 microcoulombs per gram; an A zone tribo value of 15 microcoulombs per gram and a ratio of 1.5.

Toner prepared with a NA50HS silica of the present invention, SMT5103 titania, a coated titanium dioxide wherein the coating is the decyltrimethoxysilane as indicated herein, and obtained from Tayca Inc. of Japan and 0.2 percent zinc stearate which evidenced very little change in cohesivity: 26 units before aging in the hybrid scavengeless development system and 24 units after 20 minutes of aging in the same development system; the print test data indicated excellent solid area density before and after aging with this combination of silica and titania. The print test with toners containing zinc stearate, prior art silicas, such as TS530 available from Cabosil (a fumed silica coated with hexamethyldisilane), and titanias, SMT3103, titanium dioxide particle believed to be coated with decyltrimethylsilane available from Tayca, had low cohesivity before aging, 13 units, but, high cohesivity after aging, 71 units; and in print tests, the image density was initially good (greater than 1.2) and the image density was poor (less than 1.0) after aging the toner for example in the Xerox Corporation Document Centre 265.

| | Prior Art | | | This Invention |
|---|---|---|---|---|
| | TS530 | R972 | RX515H | NA50HS |
| BET, $m^2/g$ | 215 | 110 | 50 | 50 |
| Primary size, nm | 8 | 16 | 40 | 30 |
| pH | 4.8 to 7.5 | 3.6 to 4.3 | 8 +/− 1 | 8 +/− 1 |
| Bulk density, g/l | 50 | 90 | 130 | 50 |
| Manufacturer | Cabosil | DeGussa | Nippon Aerosil/ DeGussa | Nippon Aerosil/ DeGussa |

With further respect to the prior art silicas and the silicas of the present invention, the coated silicas of the present invention are larger in size and possess other different characteristics, such as a lower bulk density in a number of instances as indicated in the above Table.

The following Examples are being submitted to further illustrate various aspects of the present invention. These Examples are intended to be illustrative only and are not intended to limit the scope of the present invention. Comparative Examples and data are also provided.

In the following examples, the final product toners were prepared by blending additives onto a parent toner generated by the following procedure, reference U.S. Pat. No. 5,352,556, the disclosure of which is totally incorporated herein by reference, especially columns 9 and 10 thereof.

There was prepared in an extrusion device, available as ZSK-92 from Werner Pfleiderer, a toner composition by adding thereto 87 percent by weight of a reactive extruded polyester resin (a linear polyester resin, propoxylated bis phenol A fumarate, Resapol Ht™ obtained from Resana was crosslinked with divinylbenzene to contain 37 percent gel), 5 percent by weight Regal 330 C-Black, 5.0 percent by weight polypropylene 660P wax, $M_w$ of about 7,000 and 3 percent by weight of the wax compatibilizer, ethylene-glycidal methacrylate copolymer. The toner was then extruded at a rate of 2,000 pounds per hour, reaching a melt temperature of about 340° F. The melt product exiting from the extruder was cooled to about 25° C. on a belt and then crushed into small particles. The resulting toner was subjected to grinding on an AFG micronizer enabling toner particles with a volume median diameter of from 8 to 10 microns as measured by a Coulter Counter. Thereafter, the aforementioned toner particles were classified in a Donaldson Model C classifier for the purpose of removing fines particles, that is, those with a number median diameter of less than about four microns; typically, the percentage of these particles was less than 10 percent of the particles in the number distribution.

COMPARATIVE EXAMPLE I

Subsequently, the above formulated parent toner, 100 parts by weight, was mixed with 3.6 parts per hundred of the prior art coated silica additive, RX515H, 40 namometers in diameter, having a bulk density of about 130 g/l and containing a coating of a mixture of hexamethyldisilazane and aminopolysiloxane and obtained from Nippon Aerosil; 2.5 parts per hundred of a titanium dioxide SMT 5103 additive; and, 0.2 parts per hundred zinc stearate. Mixing was accomplished using either a Littleford 1200 liter vertical blender (600 pounds of toner—"large scale") mixing for ten minutes or a Littleford 10 liter blender (5 pounds of toner—"small scale") mixing for 1 minute or longer.

A developer was then prepared by blending the above toner with an appropriate carrier composed of 99 parts of 110 micron diameter iron powder coated with 1 part of a polymethylmethacrylate carbon black mixture, about 21 weight percent, mixture to generate the appropriate tribo level and charging rate. The carrier coating material was comprised of 80.5 parts of polymethylmethacrylate and 19.5 parts of a conductive carbon black such as Conductex SC Ultra available from Columbian Chemicals. The developer TC (toner concentration) varies from 3 to 7 percent toner concentration with a targeted TC of 5 percent toner by weight. The developers were tested in the Xerox Corporation DC265 machines; the large scale toner was tested twice and the small scale toner once. These toners and developers had admix times of 15 seconds. The DC265 machine test results are shown in the following Table. The results indicate that the scale of the additive blender is not of high importance for these toner formulations, and also show reproducibility between machine tests. The A(t) refers to (TC+1) multiplied by the toner tribo.

| | | Machine Test Results 70° F. and 50 percent Relative Humidity | | |
|---|---|---|---|---|
| Toner Batch Size | Cohesivity Fresh/Aged | Avg A(t) for all document types | 2 percent area coverage on the document | 18 percent area coverage on the document |
| Large Scale | 25/31 | 123 | 120 | 134 |
| Large Scale | 25/31 | 127 | 119 | 134 |
| Small Scale | 25/32 | 133 | 120 | 147 |

EXAMPLE II

The above formulated parent toner, 100 parts by weight, was mixed with 3.6 parts per hundred of the invention silica additive, NA50HS, a fumed silicon dioxide, 40 nanometers in size and having a bulk density of about 50 g/l and containing a coating of a mixture of hexamethyldisilazane and γ-aminopropyltriethoxysilane and which additive was obtained from DeGussa Chemicals; 2.5 parts per hundred of a coated titanium dioxide additive where the coating is decyltrimethylsilane; and 0.2 part per hundred zinc stearate. Mixing was accomplished using a small Henschel blender for ten minutes.

A developer was then prepared by blending the toner with the carrier of Comparative Example I to generate the desired tribo level and charging rate. The developer TC varies from 3 to 7 percent toner concentration with a targeted TC of 5 percent toner by weight. The developer was tested in one DC265 machine. This toner and developer had admix times of 15 seconds. The machine test results are shown in the following Table.

| Toner Type | Cohesivity Fresh/Aged | Machine Test Results 70° F. and 50 Percent Relative Humidity | | |
|---|---|---|---|---|
| | | Avg. A(t) for All Document Types | 2 percent Area Coverage on the Document | 18 percent area Coverage on the Document |
| RX515H Toner from Example I | 25/32 | 133 | 120 | 147 |
| NA50HS Toner 1 | 26/24 | 159 | 157 | 179 |

These results indicate that the NA50HS toner has higher charging; as evidenced by the higher triboelectric A(t) values; and, no change in the cohesivity values. Fresh refers to a toner that has not been aged, and aged refers to a toned in the hybrid scavengeless developer housing for 20 minutes. This toner also possessed a high transfer efficiency of about 95 percent compared to about 80 percent of a prior art toner, such as that of the above Comparative Example.

Also, the toner cost of the present invention was reduced by about $0.80 per pound because the cost of the NA540HS (about $20 per pound) is less than the cost of RX515H (about $40 per pound).

EXAMPLE III

The above formulated parent toner, 100 parts by weight, was mixed with 2.8 parts per hundred of a silica additive, NA50HS, containing a coating of a mixture of hexamethyldisilazane and aminoptopyltriethoxysilane; 2.1 parts per hundred of the coated titania of Example II; and, 0.2 part per hundred zinc stearate. Mixing was accomplished using a small Henschel blender for ten minutes.

A developer was then prepared by blending the toner with the carrier of Example I to generate the toner tribo charge and charging rate. The developer TC varies from 3 to 7 percent toner concentration with a targeted TC of 5 percent toner by weight. This toner and developer had admix times of 15 seconds. The developer and toner were tested in the 265 machine in the 80 deg F./80 percent RH environment. The triboelectric A(t) value was 61 compared to 48 for the RX515H reference toner. The higher A(t) value for the toner generated with the NA50HS silica results in about 20 percent larger TC latitude for print quality in the machine.

Other modifications of the present invention may occur to one of ordinary skill in the art subsequent to a review of the present application, and these modifications, including equivalents thereof, are intended to be included within the scope of the present invention.

What is claimed is:

1. A toner composition comprised of binder, colorant and a surface additive mixture of a coated silica and a metal oxide, wherein the silica is coated with a mixture of γ-aminopropyltriethoxysilane and hexamethyldisilazane, wherein the metal oxide is titanium dioxide coated with decylsilane, and wherein the silica has a bulk density of from about 40 to about 60 grams/liter.

2. The toner composition according to claim 1, wherein said silica possesses a BET surface area from about 35 to about 65 $m^2/g$, and wherein the size diameter determined from the BET measurement is from about 20 to about 100 nanometers.

3. The toner composition according to claim 2, wherein the toner has an admix time of from about 1 to 29 seconds.

4. The toner composition according to claim 2, wherein the colorant is a pigment.

5. The toner composition according to claim 2, wherein the colorant is a dye.

6. The toner composition according to claim 2, wherein the coating on the silica is comprised of from about 2 to about 4 parts aminopropyltriethoxysilane per hundred parts of the silica and about 70 to about 80 parts per hundred hexamethyldisilazane per hundred parts of the silica.

7. The toner composition according to claim 1, wherein the toner has a cohesivity of about 4 to about 40 percent, with a stable triboelectric charge of from about 10 to about 35 microcoulombs per gram, a charge per particle diameter ratio of from about 0.2 to about 1.1 femtocoulombs per micron, and with an admix time of from less than about 30 seconds.

8. The toner composition according to claim 1, wherein the colorant is a pigment.

9. The toner composition according to claim 1, wherein the colorant is a dye.

10. The toner composition according to claim 1, wherein the silica coated additive is of a size diameter of from about 25 to about 75 nanometers; and wherein an aggregate of the coated silica size diameter is about 225 to about 400 nanometers.

11. The toner composition according to claim 1, wherein the silica coated additive is of a size diameter of from about 25 to about 75 nanometer; and wherein an aggregate of the coated silica size diameter is about 225 to about 400 nanometers.

12. The toner composition according to claim 1, wherein the titanium dioxide has a size diameter of about 30 to about 70 nanometers.

13. A toner composition comprised of binder, colorant and a surface additive mixture of a coated silica and a metal oxide, wherein the silica is coated with a mixture of γ-aminopropyltriethoxysilane and hexamethyldisilazane, wherein the metal oxide is coated with a silane or polymer thereof, wherein the silica has a bulk density of from about 40 to about 60 grams/liter, wherein the toner has an admix time of from about 1 to about 29 seconds.

14. A toner composition comprised of binder, colorant and a surface additive mixture of a coated silica and a metal oxide, wherein the silica is coated with a mixture of γ-aminopropyltriethoxysilane and hexamethyldisilazane, wherein the metal oxide is coated with a silane or polymer thereof, wherein the silica has a bulk density of from about 40 to about 60 grams/liter; and wherein the coating on the silica is comprised of from about 2 to about 4 parts γ-aminopropyltriethoxysilane per hundred parts of the silica and about 70 to about 80 parts hexamethyldisilazane per hundred parts of the silica.

15. The toner composition according to claim 14, wherein the toner has a cohesivity of about 4 to about 40 percent, with a stable triboelectric charge of from about 10 to about 35 microcoulombs per gram, a charge per particle diameter ratio of from about 0.2 to about 1.1 femtocoulombs per micron, and with an admix time of from less than about 30 seconds.

* * * * *